US005992360A

United States Patent [19]

Elendt et al.

[11] Patent Number: 5,992,360

[45] Date of Patent: Nov. 30, 1999

[54] VALVE DRIVE FOR GAS EXCHANGE VALVES OF INTERNAL COMBUSTION ENGINES

[75] Inventors: Harald Elendt, Wilhelmsdorf; Michael Haas, Weisendorf, both of Germany

[73] Assignee: Ina Walzlager Schaeffler oHG, Germany

[21] Appl. No.: 09/125,805

[22] PCT Filed: Oct. 4, 1996

[86] PCT No.: PCT/EP96/04330

§ 371 Date: Aug. 24, 1998

§ 102(e) Date: Aug. 24, 1998

[87] PCT Pub. No.: WO97/33076

PCT Pub. Date: Sep. 12, 1997

[30] Foreign Application Priority Data

Mar. 6, 1996 [DE] Germany ..... 196 08 651

[51] Int. Cl.[6] ..... F01L 13/00; F01L 1/18; F01L 1/24

[52] U.S. Cl. ..... 123/90.16; 123/90.46; 123/198 F

[58] Field of Search ..... 123/90.15, 90.16, 123/90.39, 90.44, 90.46, 198 F

[56] References Cited

U.S. PATENT DOCUMENTS

| | | | |
|---|---|---|---|
| 4,141,333 | 2/1979 | Gilbert | 123/198 F |
| 5,474,037 | 12/1995 | Paul | 123/90.16 |
| 5,577,469 | 11/1996 | Muller et al. | 123/90.16 |
| 5,651,335 | 7/1997 | Elendt et al. | 123/90.16 |

FOREIGN PATENT DOCUMENTS

| | | |
|---|---|---|
| 3118466 | 11/1982 | Germany . |
| 4213856 | 10/1993 | Germany . |
| 9315436 | 2/1994 | Germany . |
| 4235626 | 4/1994 | Germany . |
| 4238325 | 5/1994 | Germany . |
| 4422340 | 1/1995 | Germany . |
| 4404145 | 8/1995 | Germany . |
| 441182 | 10/1995 | Germany . |
| 2075118 | 11/1981 | United Kingdom . |

*Primary Examiner*—Weilun Lo
*Attorney, Agent, or Firm*—Bierman, Muserlian and Lucas

[57] ABSTRACT

A valve drive comprising a rocker arm (1) is provided with coupling means (13) for switching off a gas exchange valve. The coupling means (13) is hydraulically actuatable against the force of a spring (15) and the hydraulic actuation is effected from an oil supply (20) of a hydraulic clearance compensation element (6) arranged in the rocker arm (1).

5 Claims, 2 Drawing Sheets

VALVE DRIVE FOR GAS EXCHANGE VALVES OF INTERNAL COMBUSTION ENGINES

FIELD OF THE INVENTION

The invention concerns a valve drive for gas exchange valves of internal combustion engines comprising a switchable rocker arm on whose one end facing a valve stem is arranged a slidably mounted tappet element which can be coupled to or uncoupled from the rocker arm by a coupling means so that a valve lift or an idle stroke is effected, the coupling means being hydraulically actuatable against the force of a spring.

BACKGROUND OF THE INVENTION

A valve drive of the precited type is known from GB-A-2 075 118. In this rocker arm, a spring-loaded pressure pin is slidably mounted with a bottom thereof bearing against a valve stem of a gas exchange valve. Above the valve stem, the pressure piston is laterally connected by a coupling means to a spring-loaded and hydraulically displaceable piston. Depending on the end position of this hydraulically displaceable position in each case, the pressure pin is either fixed in place or displaceable so that, upon a pivoting of the rocker arm, either the gas exchange valve is actuated or the pressure pin slides in the rocker arm i.e., the gas exchange valve is not actuated. A drawback of this structure is that, on the one hand, a complicated pressure oil supply comprising a plurality of oil channels is required and on the other hand, the mechanical connection between the pressure pin and the hydraulically displaceable piston is comprised of a plurality of differently configured mechanical components. The manufacture of such a switchable rocker arm is therefore very complicated and accordingly expensive.

In this connection, a switchable valve drive is known from DE 44 11 182 A1 which comprises two transmitting levers with a hydraulically actuatable locking element arranged therebetween. This hydraulically actuatable locking element is supplied with pressure from the oil supply of the valve clearance compensation element arranged in the rocker arm. A drawback of this is that this switchable valve drive is likewise very complicated and expensive to manufacture because two transmitting levers are required.

Finally, DE-GM 93 15 436 also discloses a switchable cam follower in the form of a cup tappet which is composed of two relatively displaceable units whose coupling and uncoupling are assured respectively by a compression spring and by the oil pressure of a hydraulic clearance compensation element. However, this type of switching of two relatively displaceable units is entirely unsuitable for use in a switchable rocker arm.

SUMMARY OF THE INVENTION

It is therefore an object of the invention to create a switchable valve drive for a rocker arm which is composed of the smallest possible number of components and which can be manufactured economically.

The invention achieves this object in that an insert element is arranged in the rocker arm, which insert element receives a hydraulic clearance compensation element in a bore which is open towards a valve stem, a second end of the insert element being supported in the rocker arm via a resetting spring while a bore extending perpendicular to a longitudinal axis of the rocker arm is arranged in each of the insert element and the rear end of the rocker arm for receiving the coupling means, and the hydraulic actuation of the coupling means is effected from an oil supply of the hydraulic valve clearance compensation element which is arranged in the rocker arm.

Due to the fact that the hydraulic supply is fed from the hydraulic clearance compensation element, that is to say, it already exists, additional channels for conducting the hydraulic medium can be dispensed with. The locking under spring force without the action of pressure from the hydraulic medium, also called pressureless locking, is particularly advantageous in case all cylinders are required for an initial ignition or for a re-ignition of the internal combustion engine. On the other hand, when the internal combustion engine has been started, the oil pressure required for the supply of the hydraulic clearance compensation element is built up immediately so that, when the engine has run warm, one or more valves can be switched off without any problem in certain load ranges by an uncoupling of the coupling means by hydraulic pressure acting against the spring force.

It is understood that the kinematic reversal, i.e. pressureless unlocking also falls within the concept of the invention. In this case, locking is effected by the action of pressure of the hydraulic medium while unlocking is achieved under the action of the spring force.

The coupling means comprises a bushing arranged in the rocker arm, a slidable spring-loaded locking piston arranged in the interior of the bushing and a guide sleeve arranged in the support element and lodging a slidable locking cap.

In a further development of the invention, two coupling means are arranged opposite each other in the rocker arm. This double configuration permits a design space optimization by a miniaturization of the components.

The resetting of the rocker arm is achieved by a torsion leg spring arranged a the pivot axle of the rocker arm, one leg of the torsion leg spring engaging the rocker arm body and a second leg engaging the insert element. Radial design space otherwise required for the resetting spring lodged within the rocker arm can be saved by these structural measures.

Finally, in a further development of the invention, the bushing arranged in the rocker arm protrudes slightly into the bore of the insert element so that a stop is formed. This stop is important for the exact positioning of the insert element and the hydraulic clearance compensation element. When the rocker arm and the insert element are no longer in positive interengagement, i.e. when an idle stroke is effected, the pivoting of the rocker arm, through the spring arranged in the rocker arm, causes a slight compression of the hydraulic clearance compensation element and a displacement thereof towards the valve stem. Upon a return movement of the rocker arm, the insert element together with the hydraulic clearance compensation element is entrained into its original position by the rocker arm acting through the bushing and the stop.

The invention will now be described more closely with reference to the following examples of embodiment.

DETAILED DESCRIPTION OF THE DRAWINGS

Figure 1:
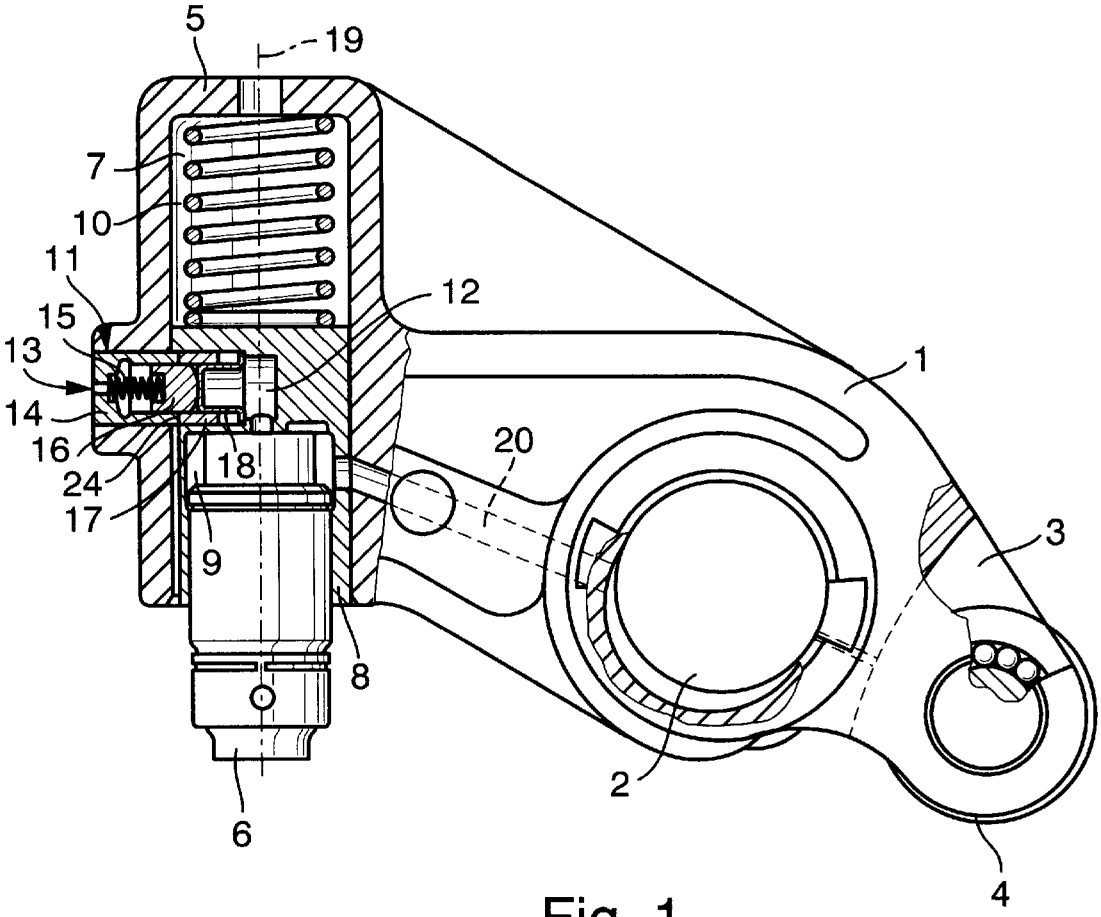
FIGS. 1 and 2 are side views of a rocker arm including fragmental sectional views thereof.

FIG. 1 shows a rocker arm 1 pivotally mounted on its axle 2. A front end 3 of the rocker arm 1 carries a rotatably mounted cam roller 4 which is loaded by a cam, not shown. In the rear end of the rocker arm 1, there is lodged a hydraulic clearance compensation element 6 which cooperates with a gas exchange valve, not shown either. The rear end 5 comprises a bore 7 which is open towards the gas exchange valve and lodges an insert element 8 whose bore 9, which is likewise open towards the gas exchange valve, receives the hydraulic clearance compensation element 6. A spring 10 compressed between an end face of the insert element 8 and the bottom of the bore 7 serves to reset the rocker arm 1.

The rear end 5 of the rocker arm 1 and the insert element 8 comprise bores 11 and 12 respectively, which extend perpendicular to the longitudinal axis 19 and lodge a coupling means 13. This coupling means 13 comprises a bushing 14 which is inserted into the bore 11 and in which a locking piston 16 loaded by a spring 15 is slidably arranged. The bushing 14 protrudes slightly into the bore 12 of the insert element 8 so that a stop 24 is formed. The coupling means 13 further comprises a guide sleeve 17 which is fixed in the bore 12 of the insert element 8, while a locking cap 18 is slidably guided in the guide sleeve 17.

The rocker arm 1 shown in the first figure is represented in the locked state i.e., in the state before the beginning of the ignition of the internal combustion engine. In this state, the locking piston 16 is pushed by the pressure of the spring 15 mechanically into the guide sleeve 17 so that a positive engagement is established between the rocker arm 1 and the insert element 8. When the cam, not shown, causes a pivoting of the rocker arm 1 about its axle 2, this pivoting motion is transformed into a vertically downward motion at the rear end 5. Since the rocker arm 1 and the insert element 8 are rigidly connected to each other by the coupling means 13 to form a unit, an opening of the gas exchange valve, not shown, is effected by the hydraulic clearance compensation element 6.

The switching-off of the gas exchange valve is achieved in that, by virtue of a pressure oil supply 20, the locking piston 16 loaded by the spring 15 is pushed back by the locking cap 18, so that the rocker arm 1 and the insert element 8 are no longer positively connected to each other. On a renewed pivoting of the rocker arm 1 about its axle 2 caused by the cam, the rear end 5 of the rocker arm 1 does indeed move downward along its axis 19 but the insert element 8 supported by the hydraulic clearance compensation element 6 and the gas exchange valve hardly changes its position i.e., it slides in the bore 7. Thus, at the bottom dead center, the reception space for the spring 10 defined between the rear end 5 and the insert element 8 is decreased in size so that the spring 10 is compressed and subsequently causes a resetting of the rocker arm 1. Due to the stop 24, upon a return movement of the rocker arm 1, the insert element 8 and the hydraulic clearance compensation element 6 are returned to the position they originally occupied prior to the idle stroke.

Figure 2:
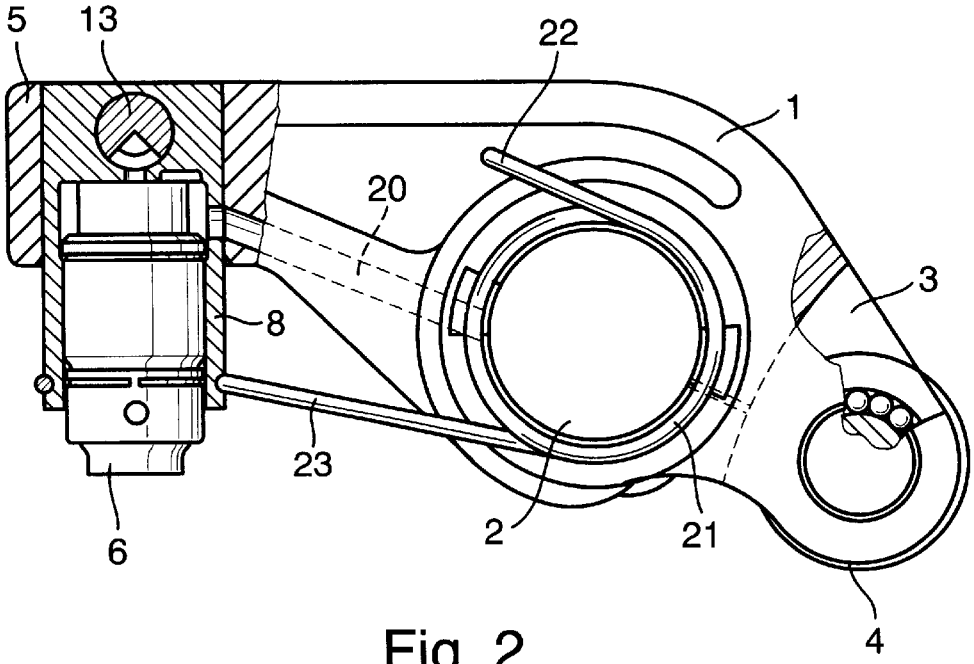
Figure 3:
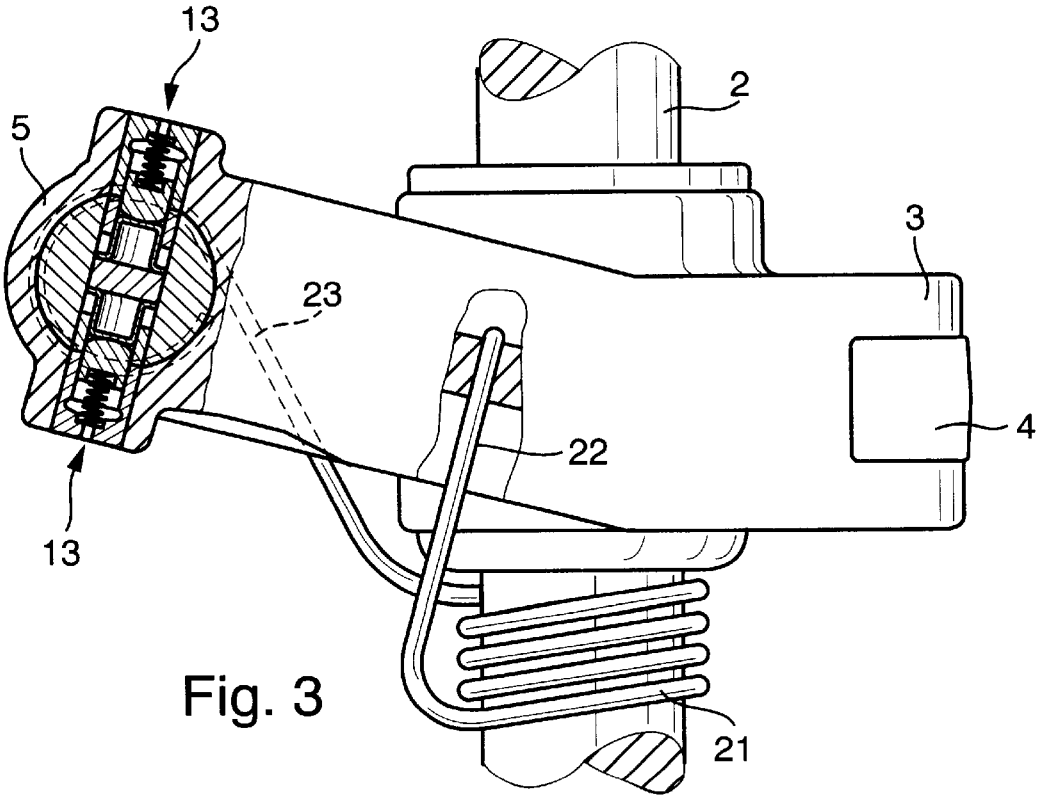
FIG. 3 is a top view of a rocker arm of FIG. 2 including a fragmental sectional view thereof.

The rocker arm shown in FIGS. 2 and 3 differs from that of FIG. 1 in that coupling means 13 are arranged at two points opposite each other and in that the resetting of the rocker arm 1 is effected by a torsion leg spring 21 arranged around the axle 2. One leg 22 of this torsion leg spring 21 bears against the rocker arm body 1 and a second leg 23 against the insert element 8.

We claim:

1. A valve drive for gas exchange valves of internal combustion engines comprising a switchable rocker arm (1) on whose one end facing a valve stem is arranged a slidably mounted tappet element which can be coupled to and uncoupled from the rocker arm (1) by a coupling means (13) so that a valve lift or an idle stroke is effected, the coupling means being hydraulically actuatable against the force of a spring, characterized in that an insert element (8) is arranged in the rocker arm (1), which insert element (8) receives a hydraulic clearance compensation element (6) in a bore (9) which is open towards a valve stem, a second end of the insert element (8) being supported in the rocker arm (1) via a resetting spring (10) while a bore (12, 11) extending perpendicular to a longitudinal axis (19) of the rocker arm (1) is arranged in each of the insert element (8) and a rear end (5) of the rocker arm (1) for receiving the coupling means (13), and the hydraulic actuation of the coupling means (13) is effected from an oil supply (20) of the hydraulic valve clearance compensation element (6) which is arranged in the rocker arm (1).

2. A switchable valve drive according to claim 1, characterized in that the coupling means (13) comprises a bushing (14) arranged in the rocker arm (1), a slidable spring-loaded locking piston (16) arranged in an interior of the bushing (14) and a guide sleeve (17) arranged in the insert element (8) and lodging a slidable locking cap (18).

3. A switchable valve drive according to claim 1, characterized in that two coupling means (13) are arranged opposite each other in the rocker arm (1).

4. A switchable valve drive according to claim 1, characterized in that the resetting of the rocker arm (1) is achieved by a torsion leg spring (21) arranged on a pivot axle (2) of the rocker arm (1), one leg (2) of the torsion leg spring (21) engaging the rocker arm body and a second leg (3) engaging the insert element (8).

5. A switchable valve drive according to claim 2, characterized in that the bushing (14) arranged in the rocker arm (1) protrudes slightly into the bore (12) of the insert element (8) so that a stop (24) is formed.

* * * * *